US005786977A

United States Patent [19]

Cohen

[11] Patent Number: 5,786,977

[45] Date of Patent: Jul. 28, 1998

[54] DEVICE FOR ELECTROSTATICALLY GROUNDING THE FEET OF PERSONS IN ELECTRONICS FACTORIES

[75] Inventor: Lenard Cohen, Southboro, Mass.

[73] Assignee: Desco Industries, Inc., Walnut, Calif.

[21] Appl. No.: 712,587

[22] Filed: Sep. 13, 1996

[51] Int. Cl.[6] ..... H05F 3/00

[52] U.S. Cl. ..... 361/223; 361/224

[58] Field of Search ..... 361/223, 212, 361/220, 224, 56, 91

[56] References Cited

U.S. PATENT DOCUMENTS

| | | | |
|---|---|---|---|
| 4,150,418 | 4/1979 | Berbeco | 361/224 |
| 4,551,783 | 11/1985 | Cohen et al. | 361/223 |
| 5,191,505 | 3/1993 | Gordon et al. | 361/223 |
| 5,448,840 | 9/1995 | Cheskin | 361/224 |

OTHER PUBLICATIONS

Advertising Brochure of Plastic Systems, "World Famous Foot Grounders" (double page (Four sides) folded once.

*Primary Examiner*—Jeffrey A. Gaffin
*Assistant Examiner*—Michael J. Sherry
*Attorney, Agent, or Firm*—Richard L. Gausewitz

[57] ABSTRACT

Apparatus for electrostatically grounding a person working in an electronics factory or other area where static electricity in persons is a problem. There is an electrostatic drain to drain static electricity to ground from a predetermined region of the person's clothing, and an assembly to drain electricity from the person to the predetermined region for making of electrical connection to the drain means and for conduction of static electricity to it. The assembly comprises an electrically conductive tab, and a thin flexible synthetic resin substrate, and a conductive film on the substrate, and a discrete high-resistance resistor mounted on the film and having its terminal portions electrically connected to spaced and mutually electrically isolated regions of the film. An end of the tab is electrically connected to the conductive film, and a package formed of thin electrically-insulating water-resistant flexible sheet material is provided. The sheet material encloses the resistor and at least a large part of the substrate.

15 Claims, 2 Drawing Sheets

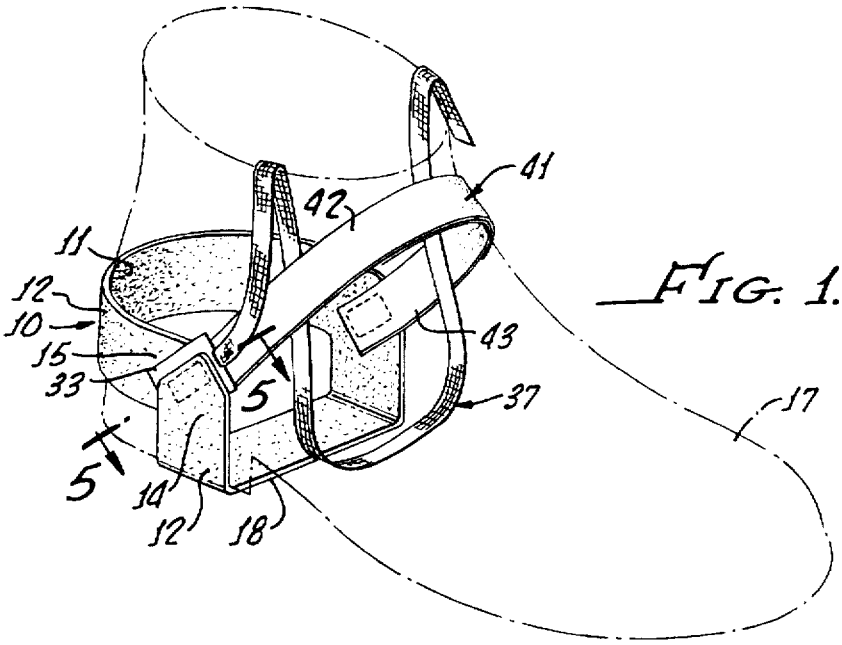
FIG. 1.
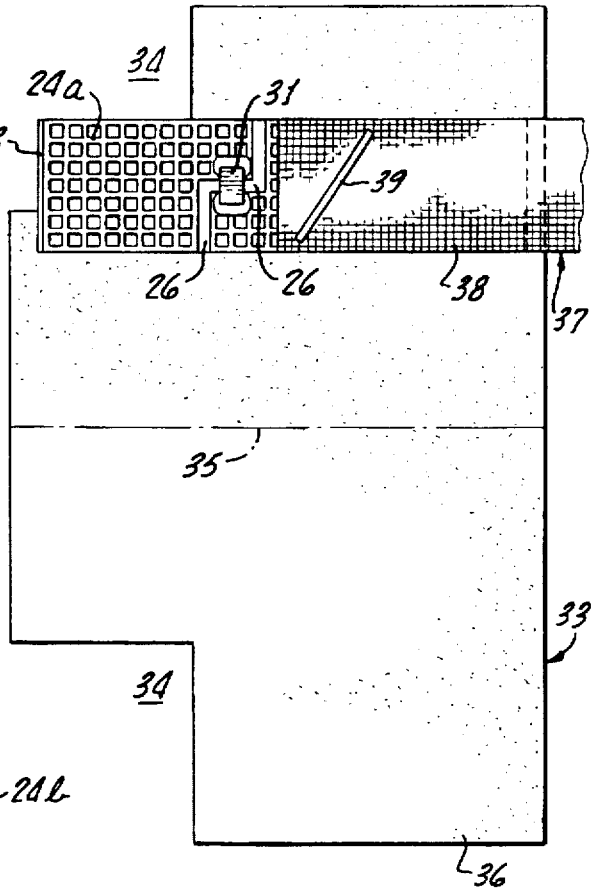
FIG. 3.
FIG. 2.
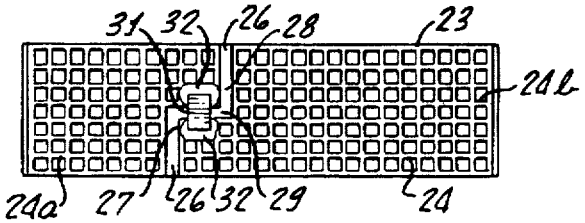

DEVICE FOR ELECTROSTATICALLY GROUNDING THE FEET OF PERSONS IN ELECTRONICS FACTORIES

BACKGROUND OF THE INVENTION

Persons manufacturing or using static-sensitive devices conventionally wear wrist straps or footwear which protects the devices from static-electricity damage, and personnel from static-electricity shocks. In the field of such footwear, it is common for personnel to wear, on the heels or toes of their shoes, strap devices that conduct the static electricity from the wearer to (for example) electrostatically conductive wax or paint on the floor. These are generically referred to herein as "foot grounders".

Relative to both foot grounders and the above-indicated wrist straps, it has become conventional—in quality systems—to use high-value discrete resistors, typically (but not necessarily) one megohm in value. In relation to wrist straps, these discrete resistors are connected in electric circuits including ground cords, etc. In relation to foot grounders, these discrete resistors are typically interposed between electrically-conductive heel straps that contact the floor, and electrically-conductive tabs (straps that extend inside the person's shoe) that contact his or her sock or skin inside the shoe or boot.

The discrete resistors and associated insulators, terminals, etc. in conventional foot grounders are hard and quite bulky. For example, rivets may be employed to hold stiff metal terminals to the hard housings containing (encapsulating) the resistor elements. These assemblies are uncomfortable to some wearers, and are costly to manufacture and assemble.

SUMMARY OF THE INVENTION

The present invention comprises a small discrete resistor that is assembled with a thin flexible substrate, the substrate having a thin flexible electric conductor thereon. The resistor is connected across a gap in the conductor. Sewing is performed to connect to a strap element of the foot grounder the conductor portion on one side of the gap, and to connect to a tab the conductor portion on the other side of the gap. The sewing and strap and tab are such that the sewing effects good electrical connections to the strap and tab, there being no need for any rivets.

Insulating and moisture-barrier layers of flexible material are provided to ensure that there will be no short circuit around the resistor, or other unwanted results.

The result is a very comfortable, soft, unobtrusive, water-resistant, compact, economical discrete-resistor assembly combined in a foot grounder.

In accordance with the method of the invention, the following occur:

(a) The same sewing that connects strap ends of the foot grounder to each other, and that connects the tab to the straps, also sews thereto the flexible substrate and flexible conductor and flexible insulating and moisture-barrier layers.

(b) An insulating and label "package" or "flag" of sewable material is preassembled with the flexible substrate and flexible conductor, and with the tab. The package serves as the insulation and moisture barrier. The package is interposed between end portions of straps of the foot grounder, and is sewn therebetween when the end portions are sewn together.

(c) The package serves additionally as an assembly aid and as a label, at little expense.

Further in accordance with the foot grounder of the invention, and further in accordance with the method:

(1) The package is so shaped and located that a printed portion thereof extends out from beneath the associated strap and is readily viewed. It is such that it may be written or printed on by the customer, and states (for example) the first day in which the heel grounder went into use.

(2) The package is a single sinall sheet of plasticized (layered or coated) paper having pressure-sensitive adhesive in one side thereof. The tab end and flexible substrate and associated conductor are pressed on the adhesive side of the paper. The paper is then folded over so as to package the assembled elements, following which the sewing occurs at any time or place. One corner of the package is omitted, so as to expose a conductor portion for excellent electric contact—by sewing—with a conductive side of a strap end portion.

BRIEF DESCRIPTION OF THE DRAWINGS

FIG. 1 is an isometric view illustrating the foot-grounder associated with a shoe, the latter being shown in phantom;

FIG. 2 is a plan view illustrating certain flexible components of the present combination;

FIG. 3 is a view schematically illustrating the package, and the flexible conductor and tab end;

DETAILED DESCRIPTION OF THE PREFERRED EMBODIMENT

Figure 4:
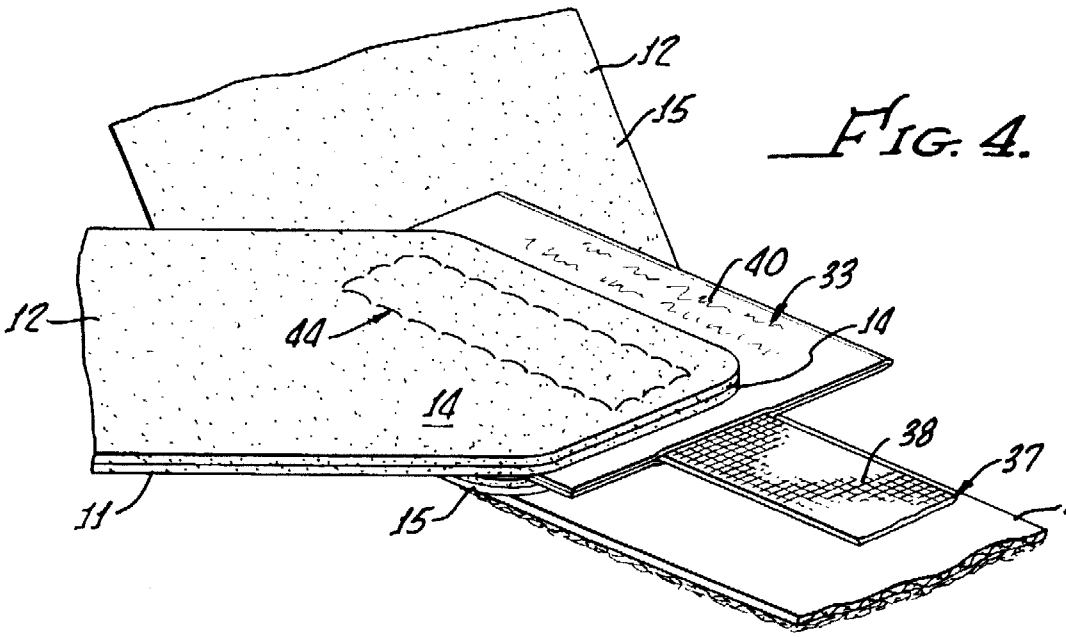
FIG. 4 is an enlarged isometric fragmentary view showing various layers.

In the drawings and detailed description, a foot grounder of the heel-grounding type is shown and described. It is to be understood, however, that the present invention may also be employed in foot-grounders of the toe-grounding type.

U.S. Pat. No. 4,551,783 is hereby incorporated by reference herein, as though set forth in full.

In the preferred embodiment of the invention, a heel cup is provided, being made of flexible rubber. Cup 10 has an inside surface 11 that is not electrostatically conductive, and an outside surface 12 that is electrostatically conductive. Stated otherwise, the strip of rubber forming heel cup 10 is a laminate, or in the nature of a laminate, the inside half (approximately) being nonconductive and the outside half (approximately) being made conductive by the addition of carbon particles or in other ways.

As set forth in the cited patent, heel cup 10 is made of a single strip of rubber, the central portion of which is bent at approximately a right angle, and the outer ends of which are adapted to be sewn together. The right angle is indicated at 13, the outside end at 14, and the inside end at 15. As described subsequently, the ends 14, 15 are sewn together when in opposed relationship relative to each other.

Heel cup 10 is illustrated as mounted on the right shoe 17 of a person working in an electronics factory (for example). When on such right shoe, U-shaped section 18 of the strip rubber forming heel cup 10 extends under the heel of the shoe, so that its outside surface 12 is in contact with the (for example) electrostatically conductive wax on the floor of the factory. The other U-shaped section of strip rubber extends substantially horizontally rearwardly around the counter of the shoe.

Figure 5:
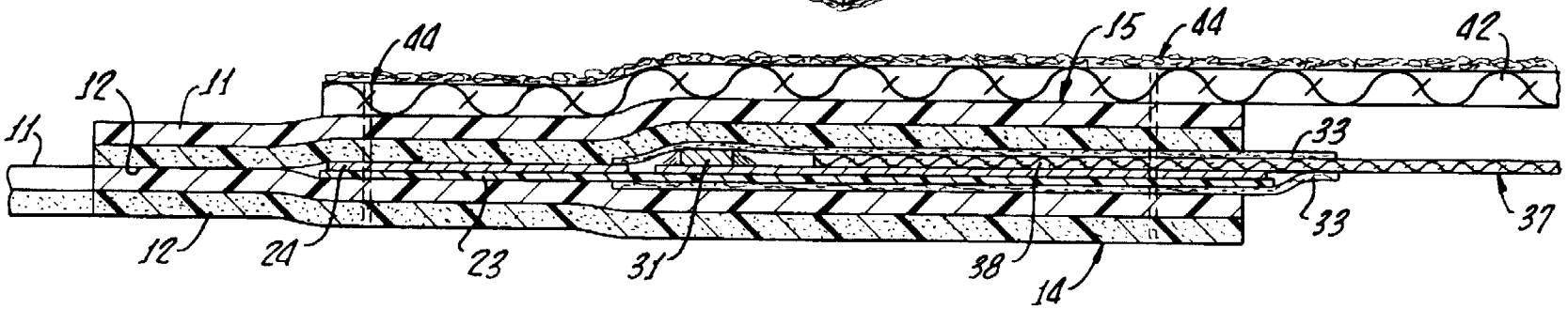
FIG. 5 is an enlarged horizontal sectional view taken on line 5—5 of FIG. 1.

Referring next to FIGS. 2 and 5, there is shown an elongate rectangular thin flexible sheet 23 (the substrate) of electrically-insulating synthetic resin. Applied to one side of sheet 23, by electroplating, is a film 24 of electrically-conductive metal. Film 24 is configured by photoetching into screen shape. Stated otherwise, it has parallel conductive lines in sets that are at right angles to each other. Photoresist, optical exposure, acid, etc., are employed to create the illustrated screen pattern.

The same photoetching process makes a gap 26 in film 24, so as to divide the film into a left portion 24*a* (FIG. 2) and a right portion 24*b* that are not in electrical contact with each other. As shown in FIG. 2, gap 26 has three parts. There are two parallel and offset portions (parts) 27, 28 that extend perpendicular to the longitudinal axis of sheet 23. The third gap portion is numbered 29; it extends between portions 27, 28 in a direction longitudinal to the film sheet 23.

Mounted on film 24 so as to bridge across the third portion 29 of gap 26 is a small discrete resistor 31. Resistor 31 is a surface-mount resistor, the axis of which extends perpendicular to the third gap portion 29. The terminal regions of resistor 31 are soldered by solder 32 to the respective film portions 24*a*, 24*b* on opposite side of gap portion 29.

Referring to FIG. 3, a package, flag and assembly aid 33 is shown in open condition prior to completion. When in such open condition, element 33 is a single sheet of thin, flexible material that is rectangular and vertically elongate (in FIG. 3), and that has corresponding cut-out corners 34. When the illustrated element 33 is folded about a central horizontal fold line 35, the cut-out corners 34 register with each other to form a single open (cut-out) corner 34 of the completed package 33.

Adjacent cut-out corner 34 to the right thereof in FIG. 3, and thus adjacent the indicated single corner opening after folding has occurred, is an assembly area. With the parts oriented as shown in FIG. 3, the assembly area is at the upper-right region of the package prior to folding thereof.

When element 33 is in the position shown in FIG. 3, prior to folding, the bottom surface thereof is supported on a table (not shown); such bottom surface is smooth and not tacky or adhesive. Conversely, when in such position the entire top surface of element 33 is tacky, being fully covered by pressure-sensitive adhesive indicated at 36.

The above-described combination of resin sheet 23, metal film 24 and resistor 31 is combined with an electrically-conductive elongate tab 37 at the left end 38 thereof. This is preferably done by a small staple 39 (FIG. 3). Then the combination conductor assembly and tab are pressed down on adhesive surface 36. Synthetic resin sheet 23 is lowermost, and both the metal film 24 and resistor 31 face upwardly.

Resistor 31 is located to the left of the tab end, as are all portions of gap 26. Left region 24*a* of metal film 24 is partially cantilevered into the cut-out corner 34, as shown. The lower portion of package 33 (FIG. 3) is then folded upwardly about fold line 35, and pressed down so as to adhere to the metal film and to the tab end.

The relationships are caused to be such that there is much exposed region of metal film portion 24*a* to engage and electrically contact the conductive outside surface 12 of the heel cup. Also, so that there is a substantial portion of conductor 24 that contacts the adhesive 36, so as to be effective in minimizing the chances of ingress of moisture to the gap 26 and to the resistor 31.

By the described single folding of the package, flag and assembly aid 33, the pressure-sensitive adhesive 36 permanently grips itself, and grips the enclosed parts, to form a strong, flexible, water-resistant enclosure or package for the resistor and associated gap.

There is a flag, display and data portion 40 (FIG. 4) of package 33, extending upwardly from the assembly area and the assembled components therein. This is pre-printed with a place for entry of the date when the product first went into use, and with the trademark of the manufacturer.

The package, flag and assembly aid is made of a thin, flexible, water-resistant material. The preferred material is paper or paper-like sheet material, laminated or coated with water-resistant flexible synthetic resin, and fiber-reinforced. One example is produced under the trademark "TYVEK" by Dupont. As indicated above, the synthetic resin layer, which is on the outside, is printable.

It is a feature of the invention that large numbers of the assemblies shown in FIG. 3 (but after the folding as described relative thereto) may be pre-manufactured and stored for desired lengths of time. Then, they are assembled with the above-described heel cup 10 and other elements, as follows.

A mounting strap 41, preferably of the hook-and-loop type, is temporarily secured to the inner surface of inside end 15 of the heel cup 10. Stated more definitely, one end of the loop portion 42 of strap 41 is precision-secured to such inside surface by rubber adhesive or other temporary means. Loop portion 42 is adapted to interact with a hook portion 43 of the mounting strap; such loop portion may be somewhat elastic.

Such temporary mounting of the end of strap 41 having occurred, it is merely necessary to dispose the package 33 and contents thereof between the outer surface of inside end 15 of the strip material forming the heel cup 10, and the inner surface of outside end 14 thereof. Then, a conventional sewing machine is used to sew everything permanently together through the package 33 and also in the cut-out corner 34. As illustrated, a seam (stitches) 44 is mechanically sewn in the shape of a rectangle through the outside end 14, through the package 33, through the inside end 15, through the cut-out corner 34, and through the end 38 of tab 37.

In passing through package 33, the thread forming seam 44 passes through both the left portion 24*a* and the right portion 24*b* of metal film 24. Because passage through the left portion is (in part) in the cut-out corner 34, the pressure of the thread forming the seam forces the conductive metal portions 24*a* and 24*b* respectively against outside surface 12 or the heel cup, and one surface of tab 37, for excellent electrical contact with both.

During the same sewing operation, the hook portion of the strap (numbered 43) may be sewn to the right-angle region 13 (FIG. 1) of heel cup 10.

With the described construction and method, a resistor of any number of ohms may be employed as desired by a particular factory or other purchaser, without a change in the method.

The entire joint containing the package and other elements is soft and flexible and comfortable, and there is a display region 40 for the date and trademark, which are readily viewable.

SPECIFIC EXAMPLE

In addition to the specific example of package material stated above, the following specifics are exemplary. The synthetic resin sheet 23 is polyimide; it could also be mylar, for example. The metal film 24 is plated onto the synthetic resin sheet to a thickness of about 0.002 inch. The synthetic resin is also about 0.002 inch thick. The thread used in the making of the seam 44 is preferably nylon, number 69. Relative to the tab 37, this is polyester resin having carbon-impregnated nylon filaments woven therethrough in four parallel lines.

The present combination may also be employed in relation to other types of clothing (besides shoes and boots) used in static-electricity control.

The foregoing detailed description is to be clearly understood as given by way of illustration and example only, the spirit and scope of this invention being limited solely by the appended claims.

What is claimed is:

1. A foot-grounding combination, which comprises:

(a) electrically-conductive grounding means adapted to be mounted on the shoe of a person in order to conduct static electricity to the floor underlying said shoe, (b) an electrically-conductive tab adapted to be inserted into said shoe to conduct static electricity from said person, and (c) means electrically connecting said tab to said grounding means to effect controlled draining of static electricity from said person to said floor, said last-named means comprising a discrete high-resistance resistor, further comprising a flexible substrate, further comprising conductor means provided on said substrate and having a gap therein, further comprising electrical connections between said resistor and portions of said conductor means on opposite sides of said gap, further comprising insulating and moisture barrier means provided to prevent a short across said gap whereby said static electricity flows from said tab to said floor through said resistor, and further comprising thread means to form a seam to thereby sew said substrate to said tab and to said grounding means to effect electrical contact between said conductor means on said substrate and (1) said tab and (2) said grounding means.

2. The invention as claimed in claim 1, in which said grounding means is a heel cup.

3. The invention as claimed in claim 1, in which said substrate is a thin sheet of insulating synthetic resin, and said conductor means is a conductive film on said sheet.

4. The invention as claimed in claim 1, in which said grounding means is a heel cup formed of a single strip of rubber, and in which said seam also makes a joint between opposite ends of said strip of rubber.

5. Apparatus for electrostatically grounding a person working in an electronics factory or other area where static electricity in persons is a problem, said apparatus comprising:

(a) electrostatic drain means to drain static electricity to ground from a predetermined region of the clothing of a person, and (b) pre-assembled means to conduct static electricity from said person to said predetermined region for making of electrical connection to said drain means and for conduction of static electricity thereto, said pre-assembled means comprising an electrically conductive tab, further comprising a thin flexible synthetic resin substrate, further comprising a conductive film on said substrate, further comprising a discrete high-resistance resistor mounted on said film and having its terminal portions electrically connected to spaced and mutually electrically isolated regions of said film, an end of said tab being electrically connected to said conductive film, and further comprising a package formed of thin electrically-insulating water-resistant flexible sheet material, said sheet material enclosing said resistor and at least a large part of said substrate.

6. The invention as claimed in claim 5, in which thread is provided in the form of a seam that passes through said package and through said substrate and through said tab and through said drain means (a) and connects said tab to said film on said substrate, and connects said film on said substrate to said drain means (a).

7. The invention as claimed in claim 5, in which said water-resistant flexible sheet material has adhesive on the side thereof that is adjacent said tab and said substrate and film.

8. The invention as claimed in claim 5, in which said water-resistant flexible sheet material has one portion that extends from said substrate and is a flag or label having indicia thereon.

9. The invention as claimed in claim 5, in which said water-resistant flexible sheet material has a region thereof that is cut out in order to permit effective electrical contact between said drain means (a) and said film on said substrate.

10. The invention as claimed in claim 5, in which said package is folded over, having one side that is pressure-sensitive adhesive and that grips together when said folding-over occurs.

11. The invention as claimed in claim 5, in which said electrostatic drain means is a heel cup having electrostatically-conductive means on the exterior thereof.

12. A method of manufacturing a heel grounder for grounding static electricity from a person, which method comprises:

(a) providing an electrically-conductive flexible elongate tab, (b) providing a thin flexible substrate having electrical conductor means on one side thereof, and having a higl h-vallie discrete resistor mounted on and in circuit with said electrical conductor means, (c) assembling an end portion of said tab with said substrate and conductor means in electrical contact with said conductor means on one side of said resistor, (d) mounting flexible electrically-insulating and moisture-barrier means over said resistor and over said conductor means, while leaving exposed a region of said conductor means on the other side of said resistor, (e) providing a flexible heel cup having an electrically-conductive surface portion, and having end portions adapted to be disposed in overlapped relationship relative to each other, (f) disposing said insulating and moisture-barrier means (d), and said tab end portion, and said substrate and conductor means and resistor, between said end portions of said heel cup, with said exposed region of said conductor means in electrical contact with said electrically-conductive surface portion of said heel cup, and (g) sewing a seam through all of the elements recited in the preceding clause (f), except said resistor, to hold them together and provide good electrical contact between said conductor means and said surface portion of said heel cup, and between said conductor means and said end portion of said tab.

13. The invention as claimed in claim 12, in which said insulating and moisture-barrier means is provided as a package around all of said elements recited in clause (d), while leaving said conductor region exposed.

14. The invention as claimed in claim 13, in which said method further comprises providing a pressure-sensitive adhesive layer on the inside of said package, and thereby sealingly relating said package to the contents thereof.

15. The invention as claimed in claim 14, in which said method further comprises employing said package as an assembly aid, by causing said package to be a single flat sheet of material, and assembling said tab end and said substrate and conductor to said material by means of said adhesive, and folding over said flat sheet to complete this package and enclose said tab end, substrate, conductor means and resistor.

* * * * *